US006202228B1

(12) United States Patent
Cox

(10) Patent No.: US 6,202,228 B1
(45) Date of Patent: Mar. 20, 2001

(54) BED ATTACHABLE CRIB

(76) Inventor: William H. Cox, P.O. Box 851, Bartow, FL (US) 33831

( * ) Notice: Subject to any disclaimer, the term of this patent is extended or adjusted under 35 U.S.C. 154(b) by 0 days.

(21) Appl. No.: 09/516,431

(22) Filed: Feb. 29, 2000

(51) Int. Cl.[7] ..... A47D 7/04; A47D 7/01
(52) U.S. Cl. ..... 5/95; 5/940
(58) Field of Search ..... 5/95, 93.1, 96, 5/424, 940

(56) References Cited

U.S. PATENT DOCUMENTS

| | | | | |
|---|---|---|---|---|
| 884,509 | * | 4/1908 | Lindsey | 5/95 |
| 4,638,307 | * | 1/1987 | Swartout | 5/940 |
| 4,803,744 | * | 2/1989 | Peck et al. | 5/940 |
| 5,148,561 | | 9/1992 | Tharalson et al. | 5/95 |
| 5,172,435 | | 12/1992 | Griffin et al. | 5/95 |
| 5,293,655 | | 3/1994 | Van Winkle et al. | 5/95 |
| 5,430,899 | | 7/1995 | Chisholm | 5/95 |
| 5,555,577 | | 9/1996 | Volpe | 5/93.1 |

* cited by examiner

*Primary Examiner*—Alexander Grosz
(74) *Attorney, Agent, or Firm*—Joseph N. Breaux

(57) ABSTRACT

A crib securable to the side of a parent's bed that includes an alarm mechanism for sounding an audible alarm when an infant attempted to climb from the crib onto the parent's bed. The crib is secured to the bedside with a crib structure bed attachment assembly. The crib structure bed attachment assembly includes two spaced under mattress boards extending from a bottom board of an open topped crib structure of the crib, past and perpendicular to a front barrier board, and a safety block secured between forward ends of the two spaced under mattress boards with adjustable length flexible tethers that are sufficiently adjustable such that the safety block is held against sides of a mattress and box spring to hold the front barrier board against an opposite side of the mattress.

2 Claims, 2 Drawing Sheets

BED ATTACHABLE CRIB

TECHNICAL FIELD

The present invention relates to child sleeping furniture and more particularly to a bed attachable crib that includes an open topped crib structure, two adjustable height crib structure vertical support legs, and a crib structure bed attachment assembly; the open topped crib structure having a child receiving cavity, a front barrier board across the front of the child receiving cavity and a child detection alarm system including an infrared diode beam generating source generating an infrared beam above the front barrier board, an infrared detector circuit, and an alarm circuit controlled by the infrared detector circuit and including an audible alarm generating mechanism triggered when the infrared beam transmitted above the front barrier board and between the infrared diode beam generating source and the infrared detector circuit is broken by a child attempting to exit the open topped crib structure; each of the two adjustable height crib structure vertical support legs including an elongated support leg having an elongated adjustment slot formed along a portion thereof and being adjustably attached to a back board of the open topped crib structure with a bolt assembly positioned through the elongated adjustment slot; the crib structure bed attachment assembly including two spaced under mattress boards extending from a bottom board of the open topped crib structure past and perpendicular to the front barrier board and a safety block secured between forward ends of the two spaced under mattress boards with adjustable length flexible tethers that are sufficiently adjustable such that the safety block is held against sides of a mattress and box spring to hold the front barrier board against an opposite side of the mattress.

BACKGROUND ART

Many parents believe that it is important for a new born child to sleep close to the parents during the first months of life. Although the parents believe such close sleeping arrangements are beneficial for the child, infants can easily be smothered by a parent while sleeping in the same bed. It would be a benefit, therefore, to have a crib that could be secured along the side of a parent's bed and within which an infant could safely sleep without the risk of a parent rolling onto and smothering the infant. Because the infant may attempt to climb from the crib onto the parent's bed at night, it would be a further benefit to have a crib that included an alarm mechanism for sounding an audible alarm when an infant attempted to climb from the crib onto the parent's bed.

GENERAL SUMMARY DISCUSSION OF INVENTION

It is thus an object of the invention to provide a bed attachable crib that includes an open topped crib structure, two adjustable height crib structure vertical support legs, and a crib structure bed attachment assembly; the open topped crib structure having a child receiving cavity, a front barrier board across the front of the child receiving cavity and a child detection alarm system including an infrared diode beam generating source generating an infrared beam above the front barrier board, an infrared detector circuit, and an alarm circuit controlled by the infrared detector circuit and including an audible alarm generating mechanism triggered when the infrared beam transmitted above the front barrier board and between the infrared diode beam generating source and the infrared detector circuit is broken by a child attempting to exit the open topped crib structure; each of the two adjustable height crib structure vertical support legs including an elongated support leg having an elongated adjustment slot formed along a portion thereof and being adjustably attached to a back board of the open topped crib structure with a bolt assembly positioned through the elongated adjustment slot; the crib structure bed attachment assembly including two spaced under mattress boards extending from a bottom board of the open topped crib structure past and perpendicular to the front barrier board and a safety block secured between forward ends of the two spaced under mattress boards with adjustable length flexible tethers that are sufficiently adjustable such that the safety block is held against sides of a mattress and box spring to hold the front barrier board against an opposite side of the mattress.

Accordingly, a bed attachable crib is provided. The bed attachable crib includes an open topped crib structure, two adjustable height crib structure vertical support legs, and a crib structure bed attachment assembly; the open topped crib structure having a child receiving cavity, a front barrier board across the front of the child receiving cavity and a child detection alarm system including an infrared diode beam generating source generating an infrared beam above the front barrier board, an infrared detector circuit, and an alarm circuit controlled by the infrared detector circuit and including an audible alarm generating mechanism triggered when the infrared beam transmitted above the front barrier board and between the infrared diode beam generating source and the infrared detector circuit is broken by a child attempting to exit the open topped crib structure; each of the two adjustable height crib structure vertical support legs including an elongated support leg having an elongated adjustment slot formed along a portion thereof and being adjustably attached to a back board of the open topped crib structure with a bolt assembly positioned through the elongated adjustment slot; the crib structure bed attachment assembly including two spaced under mattress boards extending from a bottom board of the open topped crib structure past and perpendicular to the front barrier board and a safety block secured between forward ends of the two spaced under mattress boards with adjustable length flexible tethers that are sufficiently adjustable such that the safety block is held against sides of a mattress and box spring to hold the front barrier board against an opposite side of the mattress.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
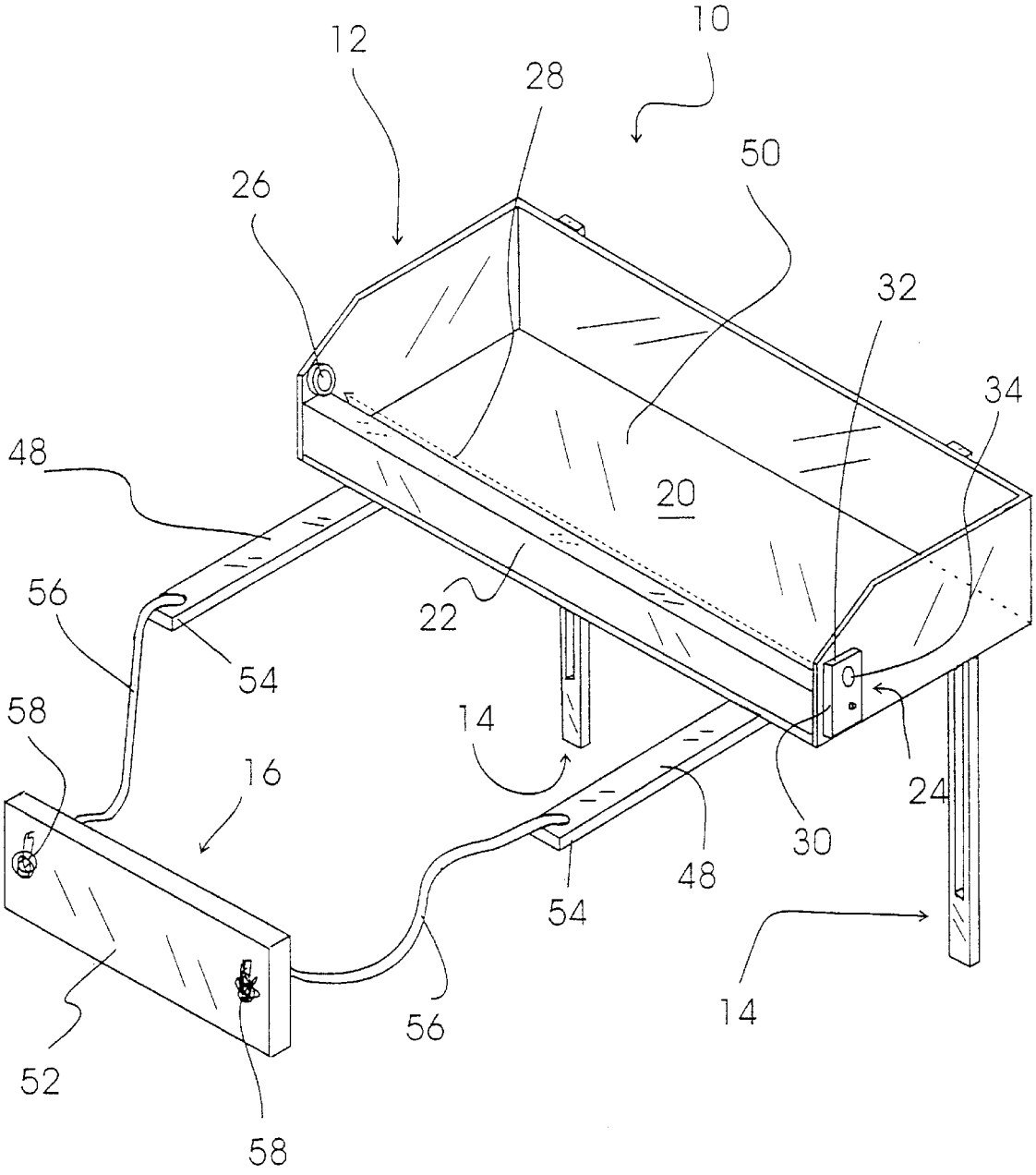
FIG. 1 is a perspective view of an exemplary embodiment of the bed attachable crib of the present invention showing the open topped crib structure, the two adjustable height crib structure vertical support legs, and the crib structure bed attachment assembly; the open topped crib structure having a child receiving cavity, a front barrier board across the front of the child receiving cavity and a child detection alarm system including an infrared diode beam generating source generating an infrared beam above the front barrier board, an infrared detector circuit, and an alarm circuit controlled by the infrared detector circuit and including an audible alarm generating mechanism triggered when the infrared beam transmitted above the front barrier board and between the infrared diode beam generating source and the infrared detector circuit is broken by a child attempting to exit the open topped crib structure; each of the two adjustable height crib structure vertical support legs including an elongated support leg having an elongated adjustment slot formed along a portion thereof and being adjustably attached to a back board of the open topped crib structure with a bolt assembly positioned through the elongated adjustment slot; the crib structure bed attachment assembly including two spaced under mattress boards extending from a bottom board of the open topped crib structure past and perpendicular to the front barrier board and a safety block secured between forward ends of the two spaced under mattress boards with adjustable length flexible tethers that are sufficiently adjustable such that the safety block is held against sides of a mattress and box spring to hold the front barrier board against an opposite side of the mattress.
Figure 2:
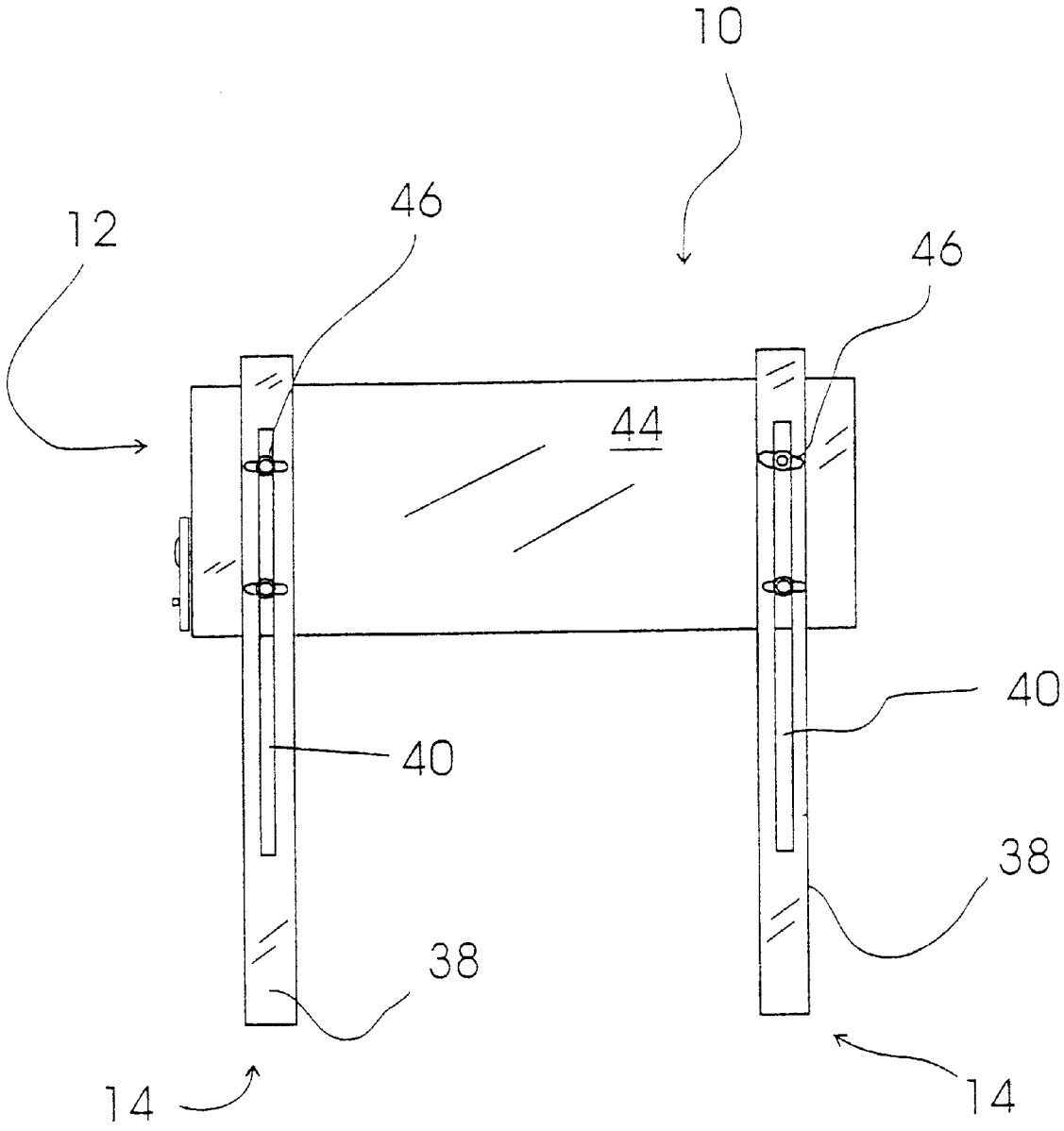
FIG. 2 is a plan view of the back side of the bed attachable crib, FIG. 1 showing the two adjustable height crib structure vertical support legs including the two bolt assemblies positioned through the two eLongated adjustment slots.

FIGS. 1 and 2 show various aspects of an exemplary embodiment of the a bed attachable crib of the present invention generally designated 10. Bed attachable crib 10 includes an open topped crib structure, generally designated 12; two adjustable heights crib structure vertical support legs, each generally designated 14; and a crib structure bed attachment assembly, generally designated 16.

Open topped crib structure 12 includes a child receiving cavity 20, a front barrier board 22 across the front of the child receiving cavity 20 and a child detection alarm system, generally designated 24 including an infrared diode beam generating source 26 generating an infrared beam 20 above front barrier board 22, an infrared detector circuit 30, and an alarm circuit 32 controlled by infrared detector circuit 30 and IncLuding an audible alarm generating mechanism 34 triggered when infrared beam 28 transmitted above front barrier board 22 and between infrared diode beam generating source 26 and infrared detector circuit 30 is broken by child attempting to exit open topped crib structure 12.

Each of the two adjustable height crib structure vertical support legs 14 includes an elongated support leg 38 having an elongated adjustment slot 40 formed along a portion thereof. Each elongated support leg 38 is adjustably attached to a back board 44 of open topped crib structure 12 with a bolt assembly 46 positioned through elongated adjustment slot 40. The height of elongated support legs 38 is adjusted such that front barrier board 22 is supported at the level of the side of the mattress on the parent's bed.

Crib structure bed attachment assembly 16 includes two spaced under mattress boards 48 that extend from a bottom board 50 of open topped crib structure 12 past and perpendicular to front barrier board 22 and a safety block 52 secured between forward ends 54 of the two spaced under mattress boards 48 with adjustable length flexible tethers 56. The length of each flexible tether 56 is adjusted by the positioning of each end knot 58 of flexible tether 56. In use, the length of flexible tether 58 is adjusted so that safety block 52 is held against one side of the mattress and a box spring and the flexible tethers 58 firmly hold front barrier board 22 against the opposite side of the mattress.

It can be seen from the preceding description that a bed attachable crib has been provided.

It is noted that the embodiment of the bed attachable crib described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bed attachable crib comprising:

an open topped crib structure;

two adjustable height crib structure vertical support legs; and a crib structure bed attachment assembly;

said open topped crib structure having a child receiving cavity and a front barrier board across a front of said child receiving cavity;

each of said two adjustable height crib structure vertical support legs including an elongated support leg having an elongated adjustment slot formed along a portion thereof and being adjustably attached to a back board of said open topped crib structure with a bolt assembly positioned through said elongated adjustment slot;

said crib structure bed attachment assembly including two spaced under mattress boards extending from a bottom board of said open topped crib structure past and perpendicular to said front barrier board and a safety block secured between forward ends of said two spaced under mattress boards with adjustable length flexible tethers that are sufficiently adjustable such that said safety block is held against sides of a mattress and box spring to hold said front barrier board against an opposite side of said mattress.

2. The bed attachable crib of claim 1 further comprising: a child detection alarm system in connection with the open topped crib structure and including an infrared diode beam generating source generating an infrared beam above said front barrier board, an infrared detector circuit, and an alarm circuit controlled by said infrared detector circuit and including an audible alarm generating mechanism triggered when said infrared beam transmitted above said front barrier board and between said infrared diode beam generating source and said infrared detector circuit is broken by a child attempting to exit said open topped crib structures.

* * * * *